US010215012B2

(12) United States Patent
McDonald et al.

(10) Patent No.: US 10,215,012 B2
(45) Date of Patent: Feb. 26, 2019

(54) APPARATUS AND METHOD OF MONITORING A ROD PUMPING UNIT

(71) Applicant: Weatherford Technology Holdings, LLC, Houston, TX (US)

(72) Inventors: Robert G. McDonald, Conroe, TX (US); Ross E. Moffett, Oklahoma City, OK (US); Jeffrey John Lembcke, Cypress, TX (US); Clark E. Robison, Tomball, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 202 days.

(21) Appl. No.: 15/212,008

(22) Filed: Jul. 15, 2016

(65) Prior Publication Data

US 2018/0016889 A1 Jan. 18, 2018

(51) Int. Cl.
*E21B 47/00* (2012.01)
*E21B 33/03* (2006.01)
*E21B 43/12* (2006.01)

(52) U.S. Cl.
CPC ..... *E21B 47/0008* (2013.01); *E21B 33/03* (2013.01); *E21B 43/127* (2013.01)

(58) Field of Classification Search
USPC ..... 396/152.61, 152.62; 73/152.61, 152.62
See application file for complete search history.

(56) References Cited

U.S. PATENT DOCUMENTS 4,064,763 A * 12/1977 Srinivasan ..... G01P 15/122 73/514.12
4,171,185 A 10/1979 Duke et al.
4,583,915 A * 4/1986 Montgomery ..... E21B 47/0008 417/18
5,252,031 A 10/1993 Gibbs
5,406,482 A * 4/1995 McCoy ..... E21B 43/127 417/63
5,589,633 A * 12/1996 McCoy ..... E21B 43/127 417/63
6,994,162 B2 2/2006 Robison
7,032,659 B2 4/2006 Barnes et al.
9,711,038 B1 * 7/2017 Pennebaker, III ..... G08C 17/02
2004/0144529 A1 * 7/2004 Barnes ..... F04B 47/02 166/53
2014/0305636 A1 10/2014 Paulet et al.

FOREIGN PATENT DOCUMENTS

EP 0900916 A1 3/1999

OTHER PUBLICATIONS

Omar Al Assad, Justin Barton, Rogier Blom, Ravi YB, Mahalakshmi SB, Gary Hughes, Eric Oestrich, Peter Westerkamp, and Craig Foster, Intelligent Rod Lift System: Fault Detection and Accommodation, Apr. 20, 2016, Southwestern Petroleum Short Course.
International Search Report and Written Opinion dated Nov. 23, 2017, for International Application No. PCT/US2017/041850.

* cited by examiner

*Primary Examiner* — Clayton E Laballe
*Assistant Examiner* — Warren K Fenwick
(74) *Attorney, Agent, or Firm* — Patterson + Sheridan, LLP

(57) ABSTRACT

A method for operating rod pumping unit for a wellbore includes measuring a parameter of the rod pumping unit at a first location; measuring the parameter of the rod pumping unit at a second location; and subtracting the measured parameters at the second location from the measured parameter at the first location.

21 Claims, 5 Drawing Sheets

APPARATUS AND METHOD OF MONITORING A ROD PUMPING UNIT

BACKGROUND OF THE INVENTION

Field of the Invention

Embodiments of the present invention generally relate to hydrocarbon production using artificial lift and, more particularly, to operating rod pumping unit based on measurements of one or more sensed parameters associated with the rod pumping unit.

Description of the Related Art

Several artificial lift techniques are currently available to initiate and/or increase hydrocarbon production from drilled wells. These artificial lift techniques include rod pumping, plunger lift, gas lift, hydraulic lift, progressing cavity pumping, and electric submersible pumping, for example.

One common problem with the rod pumping unit is various moving components of the rod pumping unit may wear down over time, thereby leading to shut down of the rod pumping unit. Examples of the moving components include bearings and gear boxes.

There is a need for apparatus and methods of monitoring wear of moving components of the rod pumping unit.

SUMMARY OF THE INVENTION

Embodiments of the present invention generally relate to measuring one or more parameters associated with a rod pumping unit and taking a course of action or otherwise operating the rod pumping unit based on the measured parameters.

In one embodiment, a method for operating a rod pumping unit for a wellbore includes measuring a parameter of the rod pumping unit at a first location; measuring the parameter of the rod pumping unit at a second location; and subtracting the measured parameters at the second location from the measured parameter at the first location. In one example, the parameter is vibration. An exemplary sensor for measuring the parameter is an accelerometer In another embodiment, a system for hydrocarbon production includes a rod pumping unit for a wellbore; a first sensor configured to detect vibration of a first moving component of the rod pumping unit; and a second sensor configured to detect vibration of a second moving component of the rod pumping unit. In one example, a measured value of the second sensor is subtracted from a measured value the second sensor. In another example, a measured value of the second sensor and a measured value the second sensor are summed.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide techniques and apparatus for measuring one or more parameters associated with an artificial lift system for hydrocarbon production and operating the system based on the measured parameters.

Rod Pumping Unit Example

Figure 1:
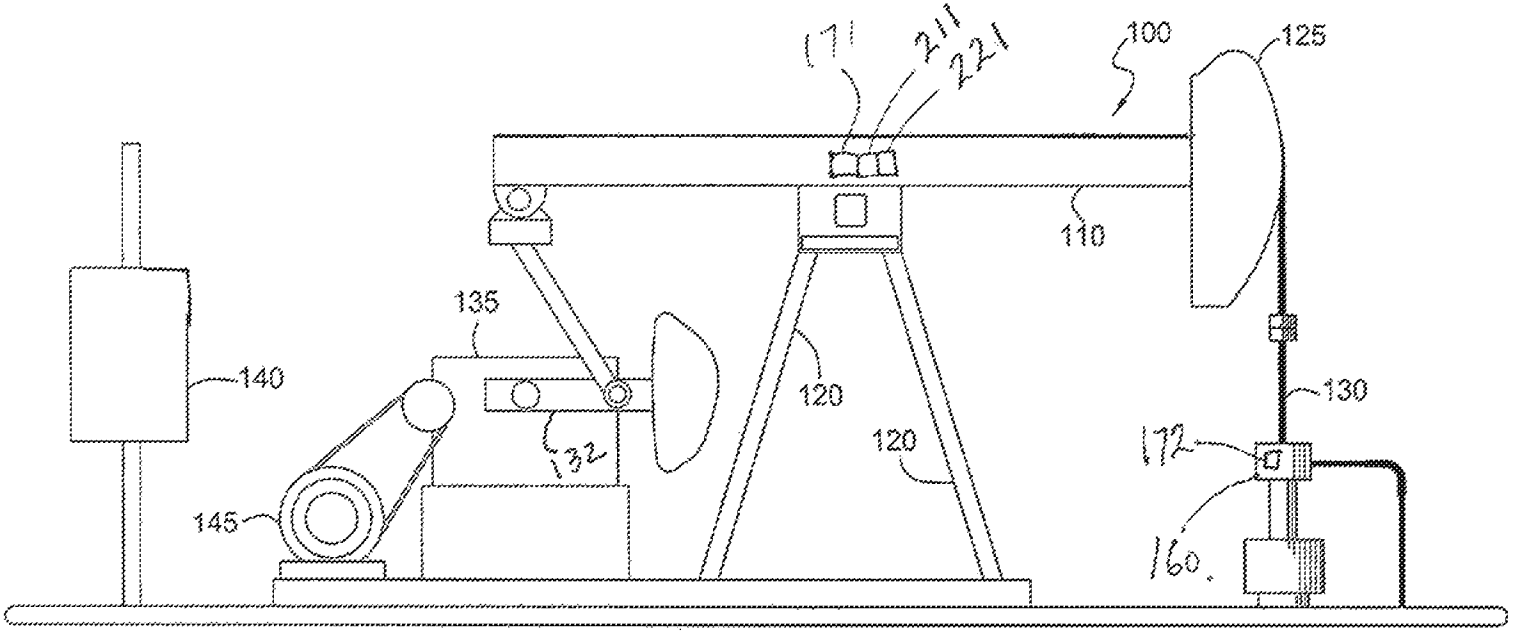
FIG. 1 is a schematic depiction of an example rod pumping unit, in accordance with embodiments of the invention.

FIG. 1 shows an embodiment a rod pumping unit 100. The rod pumping unit 100 includes a walking beam 110 operatively connected to one or more posts 120. Attached to one end of the walking beam 110 is a horse head 125 operatively connected to a polished rod 130. A rod string (not shown) is connected below the polished rod 130 and is connected to a down-hole pump (not shown). The polished rod 130 is axially movable inside the wellhead 160. The walking beam 110 is coupled to a motor 145 using a crank arm 132 and gear box 135. The rod pumping unit 100 is operated by a motor control panel 140 and powered by the motor 145.

One common problem with the rod pumping unit 100 is various moving components of the rod pumping unit 100 may wear down over time, thereby leading to shut down of the rod pumping unit 100. Examples of the moving components include bearings and the gear box.

Embodiments of the present invention provide methods and apparatus for monitoring the physical condition of these moving components. The moving components' health may be monitored by measuring vibration experienced by those moving components. In one embodiment, the rod pumping unit 100 may include one or more sensors to detect and monitor vibration of moving components of the rod pumping unit 100. For example, the rod pumping unit 100 may include an accelerometer 171 to measure the acceleration of the walking beam 110. In one embodiment, the accelerometer is a microelectromechanical system (MEMS)-based sensor. The accelerometer may be configured to produce an electrical signal that is proportional to the acceleration of the vibrating component to which the accelerometer is attached. The accelerometer 171 may be positioned close to the bearing supporting the walking beam 110. The g-force measured by the accelerometer 171 may be monitored over time to determine vibrational changes in the walking beam 110. An increase in the vibration levels as measured at the walking beam between two different time periods may indicate wear of the bearing supporting the walking beam 110. In this manner, the accelerometer 171 may be useful in helping prevent further damage to the rod pumping unit 100.

In another embodiment, a second accelerometer 172 is used to enhance the g-force measured by the first accelerometer 171. For example, the g-force measured by the first accelerometer 171 may include g-force associated with other moving components of the rod pumping unit 100 such as the polished rod 130, the crank arm 132, and the motor 145. In one example, the second accelerometer 172 may be positioned at the wellhead 160 to measure the g-force experienced by the polished rod 130. The g-force measured by the second accelerometer is subtracted from the g-force measured by the first accelerometer. In this respect, the vibration originating from the polished rod 130 may be removed from the vibration measured at the walking beam 110. In this manner, the quality of the vibration measurement from the first accelerometer 171 may be improved. It is contemplated that vibrational noise from other components such as the motor 145 and the crank arm 132 may be removed from the walking beam 110 by using additional accelerometers located at these components and subtracting these vibrations from the vibration measured at the first accelerometer.

In another embodiment, the g-force measured from the plurality of accelerometers may be summed to identify the origin of the vibration. Without wishing to be bound by theory, it is believed that because the g-force measured by the accelerometers has a directional aspect, the g-forces may be summed to triangulate the origin of the g-force.

In another embodiment, a plurality of accelerometers is positioned at each component. For example, two accelerometers may be positioned at the walking beam 110 with each accelerometer oriented in a different directions, such as along different axes. For example, the first accelerometer may be positioned in a radial direction of the bearing to detect parallel misalignment, and the second accelerometer may be positioned in an axial direction of the bearing to detect angular misalignment of the bearing. The additional accelerometer oriented in the different direction provides additional useful information on the vibration at the walking beam. In one example, the vibration measured from the second accelerometer is subtracted from the first accelerometer to enhance the signal of the first accelerometer.

In another embodiment, the sensor is configured to measure another parameter of the moving components of the rod pumping unit 100. For example, the sensor may be an acoustic based sensor for monitoring the sound of the moving components. For example, the sensor may be a microphone. The sound of the moving component may indicate wear of declining performance of the component in the rod pumping unit. Other suitable parameters include temperature or pressure. The sensors measuring the same parameter may be summed or subtracted as discussed above. For example, acoustics signals from various acoustic based sensors may be summed or subtracted to enhance the acoustic signal of one or more of the sensors.

In another embodiment, a temperature sensor is used to measure the temperature of a bearing or other moving component. The measured temperature can be compared with the average temperature of other similar situated components in order to detect impending failure, since failing bearings have higher temperatures. Detection of potential failure may be used to confirm detections by other sensors such as an accelerometer as discussed herein. In one example, a temperature sensor may be placed on a plurality of moving components of the pumping unit 100. The temperature of a moving component, such as the bearing, can be compared to the temperature of other moving components on the same side of the sun.

In another embodiment, the sensor data, such as values measured by the accelerometer, may be analyzed using Fast-Fourier Transforms ("FFT"). The FFT may be used in conjunction with the intensity of any G-shock in order to make a determination as to the failure of an individual moving component. In one embodiment, an FFT is represented as a spectrogram, on an X-Y scale of time and frequency, with stronger activity at different frequencies indicated by color. In another embodiment, an FFT is represented as a cumulative X-Y chart of frequency and dB (strength) during some sample period of variable time. In one example, the signature of a normal (e.g., first) operation is compared to the signature of a later operation. The vibration of the bearing and the motor may appear at different frequencies on the X-Y chart, such the bearing vibration at a higher frequency than the vibration of the motor. A change in the higher frequency representing the vibration of the bearing may indicate a potential failure of the bearing.

In another embodiment, the directional aspect of the accelerometer may be utilized to identify the location of the signal. For example, if the accelerometer is a three-axis accelerometer, such X, Y, and Z axial directions, the measurements from the three axes can be composed into a vector sum, which may be used to identify or triangulate the location of any particular shock signature, or frequency domain shock.

In another embodiment, the intensity of a g-force measurement at one location is compared to the g-force measured at other locations may localize the shock to the sensor with the highest measured g-force. For example, a plurality of accelerometers may be oriented in the axis and positioned on a plurality of moving components.

In another embodiment, detection of periodicity of shocks may be used to substantiate that a problem is consistent or to indicate an intermittent failure. For example, the measured data can be analyzed to identify that a certain event indicating potential failure, such as a change in vibration, occurs periodically. Identification of this periodic occurrence may confirm a persistent problem requiring repair or other intervention. In another example, event such as change in vibration may occur during the same position of the rod's cycle. Detection of this type of event may help identify the type of problem encountered by the pumping unit.

In another embodiment, data from different types of sensors, such as an accelerometer and a temperature sensor, may be analyze in combination to corroborate the likelihood of a failure and to increase the certainty of failure event determination. For example, a failure of bearing detected by the accelerometer may be confirmed by a temperature increase as measured by the temperature sensor.

In one embodiment, the signals from the accelerometer may be communicated using wireless communication. For example, radio frequency identification tags ("RFID") may be used to communicate the signal from the accelerometer. In one example, the accelerometer is operatively coupled to a RFID, which can be either an active RFID or a passive RFID. When the RFID's antenna receives electromagnetic energy from an RFID reader's antenna, the RFID may trigger the accelerometer to take a measurement of the vibration. The measured value is stored in the RFID to be read by the reader. Using power from its internal battery or power harvested from the reader's electromagnetic energy, the RFID sends the measured value back to the reader. In the example of a passive RFID, the reader can store the most current values. The stored values may be compared to previous values to identify potential issues regarding the pumping unit 100. In the example of an active RFID, data can be stored onboard and analyzed by a computer In another example, the stored data can be transmitted via a low power Bluetooth to a nearby receiver for analysis by a computer operatively connected to the receiver.

In another example, the accelerometer may be part of sensor assembly having a radio unit 211 having an antenna 221 for remote communication with a control element such as the motor control panel 140. It is contemplated that the sensor assembly includes any suitable communication ports, antenna, and radio unit known to a person of ordinary skill in the art. In another embodiment, the signals from the accelerometer may be transmitted using wireless communication to a portable control unit. In another embodiment, the data from the accelerometer or other sensors is communicated to a controller to gather, store and analyze data from one or more remote wired or wireless sensors. A portable device such as a handheld device may be used to retrieve and review data from the sensors and/or the controller via wired or wireless protocol. Data from the sensors and/or the controller may be communicated to a centralized server on the world-wide web to notify users of maintenance or failure issues. Exemplary wireless protocols include radio frequency, Bluetooth, zigbee, RFID, and other suitable wireless protocols known to a person of ordinary skill in the art.

In yet another embodiment, a RFID enabled accelerometer and/or gyroscope may be attached to an end of a rotating shaft coupled to a moving component. The accelerometer may provide information regarding vibration of the shaft. In addition to or alternatively, the accelerometer and/or gyrometer may provide information regarding the orbit of the shaft, which may indicate misalignment or unbalanced loads. For example, a three-axis accelerometer and a three-axis gyroscope may be used in combination to measure circumferential position of the shaft.

Operating a Rod Pumping Unit

Figure 2:
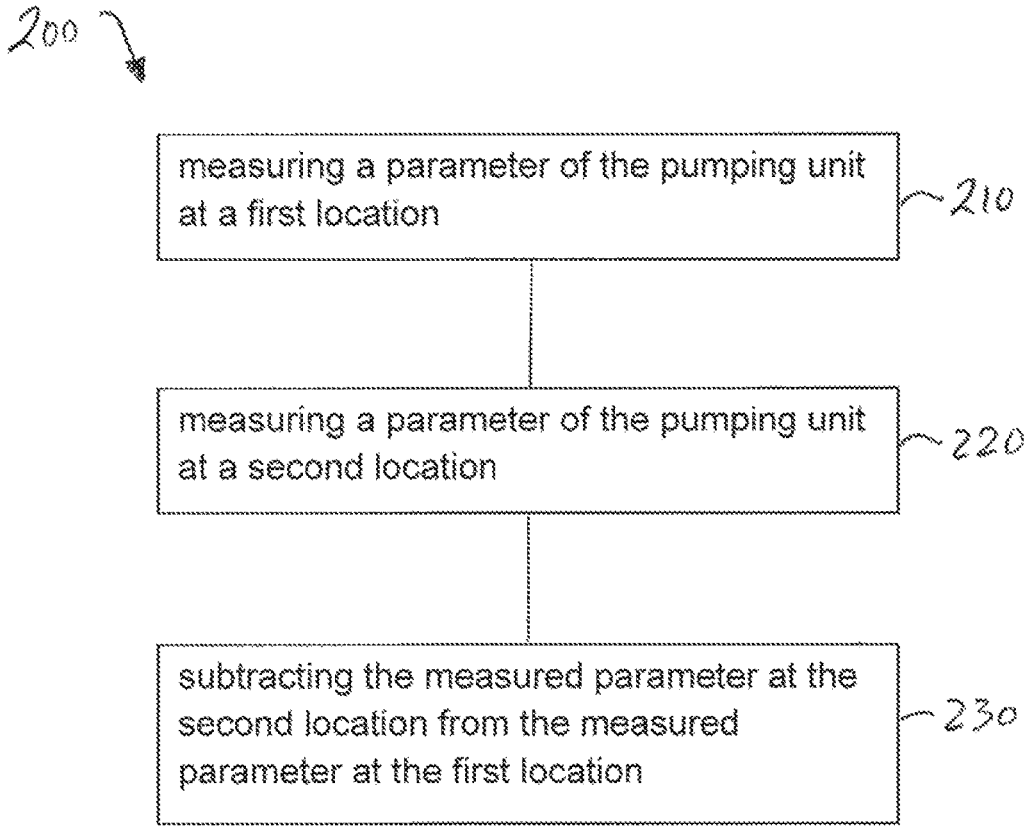
FIG. 2 is a flow diagram of example operations for operating a rod pumping unit, in accordance with embodiments of the invention.

FIG. 2 is a flow diagram of example operations 200 for a rod pumping unit for a wellbore, in accordance with certain aspects of the disclosure. Performing the operations 200 may prevent damage to the rod pumping unit. In some cases, performing the operations 200 can identify wear of moving components to prevent further damage to the pumping unit.

The operations 200 may begin, at block 210, by measuring a parameter of the pumping unit at a first location, such as the walking beam. Measuring at block 210 may include using at least one sensor to detect the vibration at the walking beam. For example, the sensor is an accelerometer configured to measure vibration. The sensor is positioned close to the bearing supporting the walking beam.

At block 220, the parameter is measured at a second location of the pumping unit, such as the wellhead. Measuring at block 220 may include using at least one sensor to detect the vibration at the wellhead. For example, the sensor is an accelerometer configured to measure vibration. The sensor is positioned on the wellhead close to the polished rod 139.

At block 230, the parameter measured at the second location is subtracted from parameter measured at the first location. Subtracting the vibration measured at the wellhead from the vibration measured at the walking beam may enhance the vibrational information provided by the walking beam only.

The measured values from the accelerometer may be transmitted using wireless transmission. The measured value may be transmitted to a portable control panel.

Any of the operations described above, such as the operations 200, may be included as instructions in a computer-readable medium for execution by the control panel 140 or any suitable processing system. The computer-readable medium may comprise any suitable memory or other storage device for storing instructions, such as read-only memory (ROM), random access memory (RAM), flash memory, an electrically erasable programmable ROM (EEPROM), a compact disc ROM (CD-ROM), or a floppy disk.

Crank Case Oil Example

Figure 3:
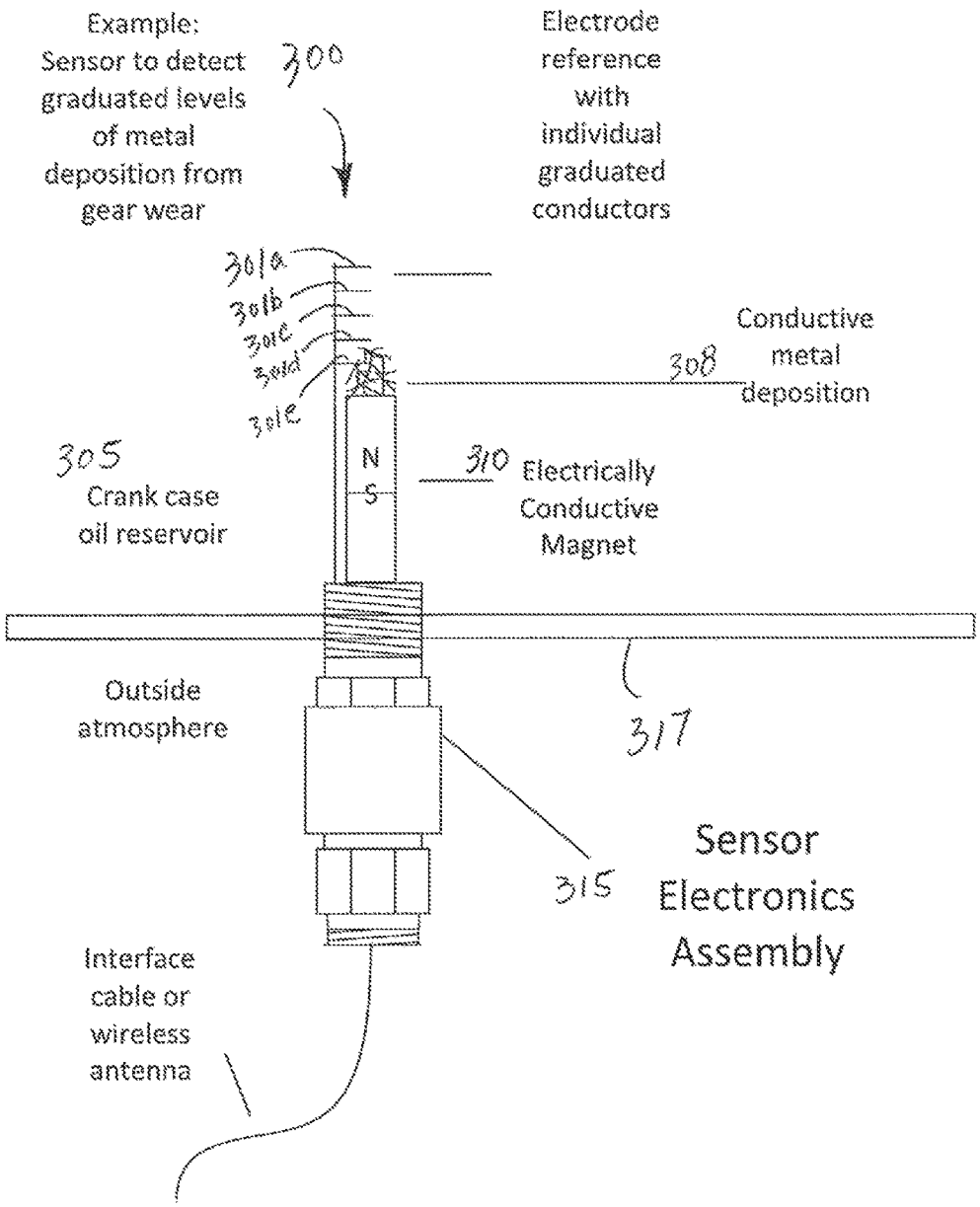
FIG. 3 shows an embodiment of a sensor for monitoring oil for use with a pumping unit.

FIG. 3 illustrates a sensor 300 for monitoring the health of a lubricant such as the crank case oil 305. The sensor 300 is configured to detect graduated levels of metal 308 deposition from gear wear. In one embodiment, a sensor 300 includes a graduated scale of individual electrodes 301*a*-301*e*, a conductive magnet 310, and a digital input sensing circuit 315. As shown, the sensor 300 is coupled to a wall 317 of a container holding the oil 305, and the electrodes 301*a*-301*e* and the magnet 310 are disposed in the oil 305 inside the wall 317. The conductive magnet 310 causes the metal 308, freed from the gear as a result of wear, to accumulate on the magnet 310. The electrodes 301*a*-301*e* are configured to detect the level of accumulated metal 308. An increase in the rate of accumulation may indicate a potential for failure of the gear. In another embodiment, the sensor 300 is configured to measure the conductivity of oil 305 via the uppermost graduated electrodes using a Wheatstone bridge or similar resistance measuring circuit. The conductivity of the oil may be measured between two electrodes 301*a*-301*e*. For example, the conductivity may be measured between electrode 301*a* and electrode 301*b*, between electrode 301*a* and electrode 301*c*, between electrode 301*b* and electrode 301*c*, or other suitable combinations. An increase in conductivity may represent an increase in the metal content of the oil 305, thereby indicating a potential for failure of the gear. The sensed data can be transmitted either via a wireless or wired protocol.

Figure 4:
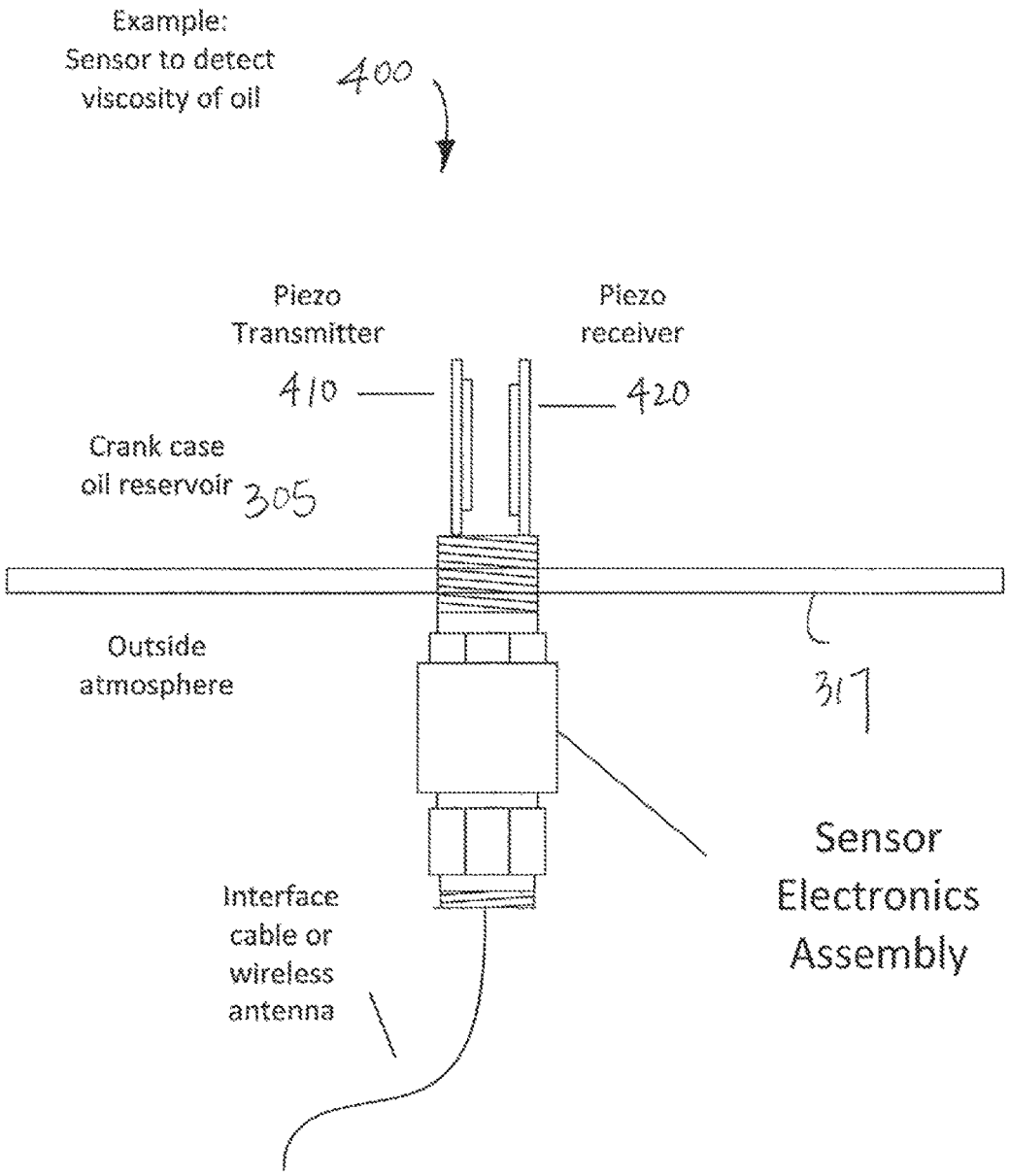
FIG. 4 shows another embodiment of a sensor for monitoring oil for use with a pumping unit.
Figure 5:
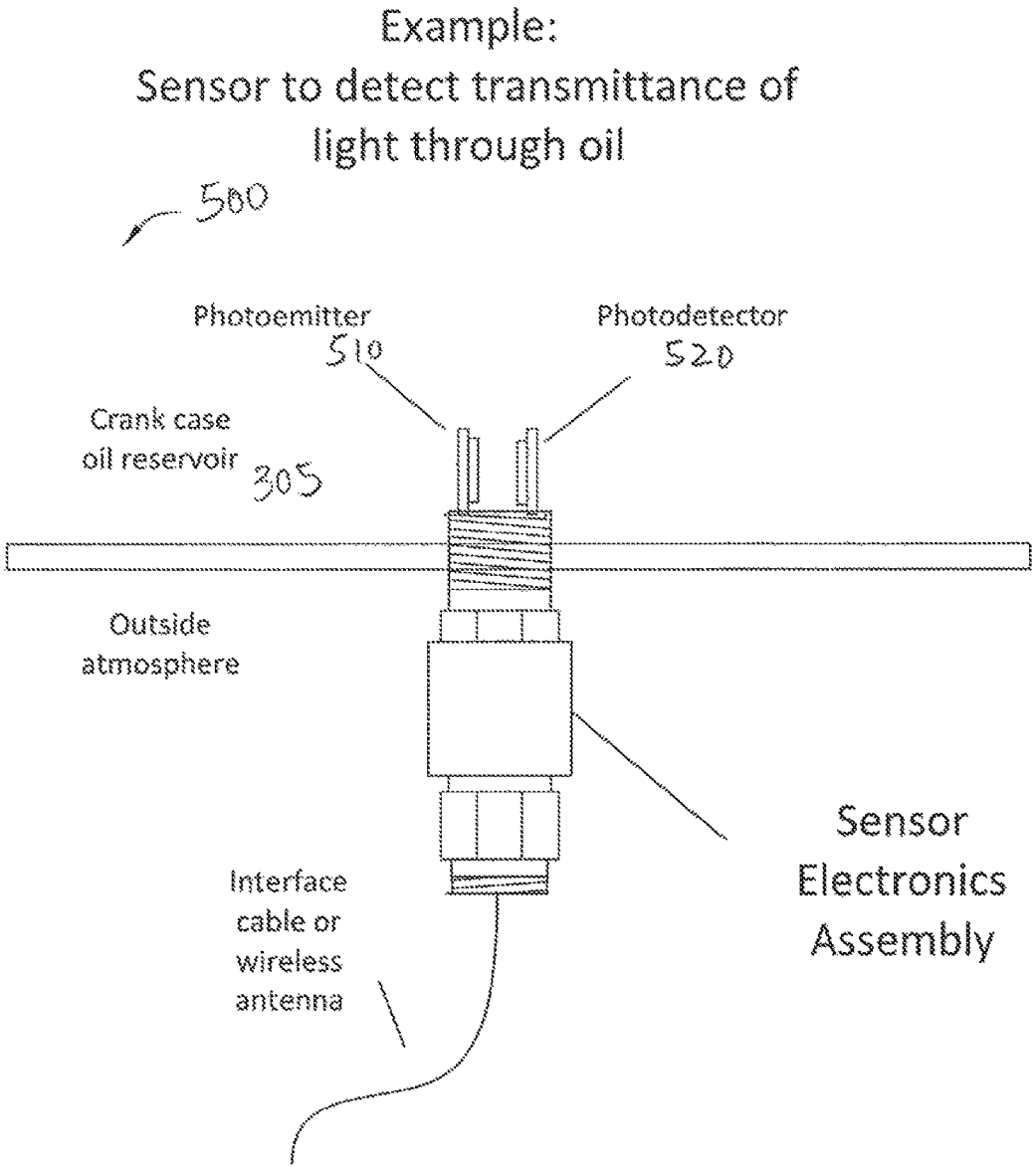
FIG. 5 shows yet another embodiment of a sensor for monitoring oil for use with a pumping unit.

In another embodiment, a sensor 400 is configured to detect the viscosity of oil 305 based on phase-shift of sound waves propagated through oil 305. As shown in FIG. 4, the sensor 400 includes a piezo transmitter 310 and a piezo receiver 320. The sensor 400 is coupled to a wall 317 and the transmitter 310 and the receiver 320 are disposed in the oil 305 inside the wall 317. Because the speed of sound through the fluid changes as the viscosity changes, a detected change in the speed of sound may indicate a potential for failure of the gear. The sensed data may be transmitted either via a wireless or wired protocol.

In another embodiment, a sensor 500 is configured to detect transmittance of light through oil 305 using a photoemitter 510 (such as an LED), a gap 515 through the oil 305 and a photodetector 520 (such as a photovoltaic cell or photoresistor). As the oil 305 darkens from use, the transmittance of light from the photoemitter 510 to the photodetector 520 will decrease over time, resulting in a smaller signal sent by the photodetector 520. The sensed data may be transmitted either via a wireless or wired protocol.

In another embodiment, two or more of the sensors 300, 400, 500 may be used in combination to monitor the health of the oil 305. Two or more of the sensors 300, 400, 500 may be provided separately or combined into a single sensor unit.

In yet another embodiment, a sensor may be mounted on the wellhead to detect a plurality of potential failures downhole. In one example, the sensor may be the sensor 172 mounted on the wellhead as shown in FIG. 1. The sensor may be vibration sensor such as an accelerometer or a sound sensor such as a microphone, which detects the sound from the mechanical vibration. In one example, the sensor is configured to detect a leak caused by a worn stuffing box. The worn stuffing box may generate a vibration or a sound that can be detected by the accelerometer or the microphone. In another example, the sensor is configured to detect the rod contacting the stuffing box or the pump at the top and the bottom of its travel. The contacts may generate a vibration or a sound that can be detected by the accelerometer or the microphone. In another example, the sensor is configured to detect the rod rubbing the tubing excessively. The excessive rubbing may generate a vibration or a sound that can be detected by the accelerometer or the microphone. In another example, sensor may be configured to detect gas breakout and/or gas locking of the pump. Both of these events may generate a vibration or a sound that can be detected by the accelerometer or the microphone. In another embodiment, pump wear and pump fillage (or lack thereof) may generate a vibration or a sound that can be detected by a sensor such as a accelerometer or a microphone.

In one embodiment, a method for operating a rod pumping unit for a wellbore includes measuring a parameter of the rod pumping unit at a first location; measuring the parameter of the rod pumping unit at a second location; and subtracting the measured parameter at the second location from the measured parameter at the first location.

In one or more of the embodiments described herein, the parameter is vibration.

In one or more of the embodiments described herein, the parameters are measured using a sensor for detecting vibration.

In one or more of the embodiments described herein, the sensor comprises an accelerometer.

In one or more of the embodiments described herein, the accelerometer at the first location and the accelerometer at the second location are oriented in the same axial direction.

In one or more of the embodiments described herein, the sensor comprises an acoustics based sensor.

In one or more of the embodiments described herein, the method includes using wireless communication to transmit the measured parameters to a control panel.

In one or more of the embodiments described herein, the wireless communication is selected from the group consisting of radio frequency identification tag, radio frequency, Bluetooth, and zigbee.

In one or more of the embodiments described herein, the first location comprises a walking beam.

In one or more of the embodiments described herein, the second location comprises a wellhead for the wellbore.

In one or more of the embodiments described herein, the parameter is sound.

In one or more of the embodiments described herein, the method includes detecting an impending failure at the first location.

In one or more of the embodiments described herein, the method includes corroborating the impending failure at the first location using a second parameter.

In one or more of the embodiments described herein, the method includes measuring the second parameter at the first location; measuring the second parameter at the second location; and comparing the second parameters to detect the impending failure at the first location.

In another embodiment, a system for hydrocarbon production includes a rod pumping unit for a wellbore; a first sensor configured to detect vibration of a first moving component of the rod pumping unit; and a second sensor configured to detect vibration of a second moving component of the rod pumping unit.

In one or more of the embodiments described herein, a measured value of the second sensor is subtracted from a measured value of the first sensor.

In one or more of the embodiments described herein, a measured value of the second sensor and a measured value of the first sensor are summed.

In one or more of the embodiments described herein, the second sensor is positioned at a wellhead.

In one or more of the embodiments described herein, the first sensor is positioned on a walking beam.

In one or more of the embodiments described herein, the first and second sensors comprise an accelerometer.

In one or more of the embodiments described herein, the first and second sensors comprise an acoustic based sensor.

In one or more of the embodiments described herein, the system includes a controller configured to subtract a measured value of the second sensor from a measured value the first sensor.

In one or more of the embodiments described herein, the system includes a controller configured to sum a measured value of the second sensor from a measured value the first sensor.

In one or more of the embodiments described herein, the system includes a controller configured to compare a measured value of the second sensor to a measured value the first sensor using Fast Fourier Transform.

In another embodiment, a method for operating a rod pumping unit for a wellbore includes measuring a parameter along a first axis of a sensor; measuring the parameter along a second axis of the sensor; composing the measured parameters into a vector sum; and identifying a location of an event represented by the parameter.

In one or more of the embodiments described herein, the parameter is vibration.

In one or more of the embodiments described herein, the sensor comprises an accelerometer.

In another embodiment, a method for operating a rod pumping unit for a wellbore includes measuring a first temperature of a first moving component; measuring a second temperature of a second moving component; and comparing the first temperature to the second temperature to detect an impending failure of the first moving component.

In another embodiment, a method for operating a rod pumping unit for a wellbore includes monitoring a condition of an oil for use with the pumping unit using a sensor immersed in the oil, wherein the sensor is configured to detect at least one of a metal content of the oil, a viscosity of the oil, and a transmittance of light through the oil; and comparing the condition at a first time to the condition at a second time.

In another embodiment, a method for operating a rod pumping unit for a wellbore includes measuring a parameter of a first moving component; measuring the parameter of a second moving component; and comparing the measured parameter of the first moving component to the measured parameter of the second moving component to detect an impending failure of the first moving component.

In one or more of the embodiments described herein, the parameter is selected from the group consisting of temperature, vibration, sound, and combinations thereof.

In one or more of the embodiments described herein, comparing the measured parameters are performed at a plurality of time periods.

In one or more of the embodiments described herein, the parameter is acceleration, and comparing the measured parameter comprises subtracting the measured parameter of the second moving component from the measured parameter of the first moving component.

In one or more of the embodiments described herein, comparing the measured parameter is performed using fast-fourier transform.

While the foregoing is directed to embodiments of the present invention, other and further embodiments of the invention may be devised without departing from the basic scope thereof, and the scope thereof is determined by the claims that follow.

The invention claimed is:

1. A method for operating a rod pumping unit for a wellbore, comprising:

measuring a parameter of the rod pumping unit using a first sensor disposed at a first location;

measuring the parameter of the rod pumping unit using a second sensor disposed at a second location; and subtracting the measured parameter at the second location from the measured parameter at the first location.

2. The method of claim 1, wherein the parameter is vibration.

3. The method of claim 1, wherein the first and second sensors are configured to detect vibration.

4. The method of claim 3, wherein the first and second sensors comprise an accelerometer.

5. The method of claim 4, wherein the accelerometer at the first location and the accelerometer at the second location are oriented in the same axial direction.

6. The method of claim 3, wherein the first and second sensors comprise an acoustics based sensor.

7. The method of claim 1, further comprising using wireless communication to transmit the measured parameters to a control panel.

8. The method of claim 7, wherein the wireless communication is selected from the group consisting of radio frequency identification tag, radio frequency, Bluetooth, and zigbee.

9. The method of claim 1, wherein the first location comprises a walking beam.

10. The method of claim 9, wherein the second location comprises a wellhead for the wellbore.

11. The method of claim 1, further comprising detecting an impending failure at the first location.

12. The method of claim 11, further comprising corroborating the impending failure at the first location using a second parameter.

13. The method of claim 12, further comprising:

measuring the second parameter at the first location;

measuring the second parameter at the second location; and comparing the second parameters to detect the impending failure at the first location.

14. A method for operating a rod pumping unit for a wellbore, comprising:

measuring a parameter along a first axis of a sensor;

measuring the parameter along a second axis of the sensor;

composing the measured parameters into a vector sum; and identifying a location of an event represented by the parameter.

15. The method of claim 14, wherein the parameter is vibration.

16. The method of claim 14, wherein the sensor comprises an accelerometer.

17. A method for operating a rod pumping unit for a wellbore, comprising:

measuring a parameter of a first moving component;

measuring the parameter of a second moving component; and comparing the measured parameter of the first moving component to the measured parameter of the second moving component to detect an impending failure of the first moving component.

18. The method of claim 17, wherein comparing the measured parameter is performed using fast-fourier transform.

19. The method of claim 17, wherein the parameter is selected from the group consisting of temperature, vibration, sound, and combinations thereof.

20. The method of claim 17, wherein comparing the measured parameters are performed at a plurality of time periods.

21. The method of claim 17, wherein the parameter is acceleration, and comparing the measured parameter comprises subtracting the measured parameter of the second moving component from the measured parameter of the first moving component.

* * * * *